US006082915A

United States Patent [19]

Kimmel

[11] Patent Number: 6,082,915

[45] Date of Patent: Jul. 4, 2000

[54] LIQUID FILLED SQUEEGEE FOR SIDE VIEW MIRROR

[76] Inventor: Harry L Kimmel, 259 S. Allen Rd., St. Clair, Mich. 48079

[21] Appl. No.: 09/336,852

[22] Filed: Jun. 21, 1999

[51] Int. Cl.[7] ..... A47L 1/08

[52] U.S. Cl. ..... 401/23; 401/25; 401/27; 401/139; 401/176; 401/183

[58] Field of Search ..... 401/23, 25, 27, 401/144, 137, 139, 176, 136, 183

[56] References Cited

U.S. PATENT DOCUMENTS

| | | | |
|---|---|---|---|
| 1,535,304 | 4/1925 | Gerdin | 401/23 X |
| 1,570,013 | 1/1926 | Smith | 401/136 X |
| 2,587,382 | 2/1952 | Pyne | 401/139 |
| 3,337,899 | 8/1967 | Rentfrow | 401/144 X |
| 3,455,638 | 7/1969 | Braswell | 401/25 X |
| 4,944,623 | 7/1990 | McNeil | 401/25 |

FOREIGN PATENT DOCUMENTS

| | | | |
|---|---|---|---|
| 1060141 | 3/1954 | France | 401/136 |
| 635741 | 4/1983 | Switzerland | 401/139 |
| 854652 | 11/1960 | United Kingdom | 401/23 |

*Primary Examiner*—David J. Walczak
*Attorney, Agent, or Firm*—Michael I. Kroll

[57] ABSTRACT

The present invention 10 discloses a squeegee 20 having an enlarged receptacle 12 for storing cleaning fluid 22 therein. The receptacle 12 is equipped with filling means 16 whereby fluid 22 can be placed inside the receptacle 12. The present invention 10 is equipped with a head member 14 having a blade 18 for wiping a proximate object along with a sponge-like member 20 for scrubbing the proximate object. Alternative embodiments are provided wherein a nozzle 35 is placed on the head 14 whereby the receptacle 12 can be squeezed thereby forcing a stream of fluid 22 through nozzle 35 onto the proximate object to be cleaned. In another alternative embodiment the receptacle 38 is equipped with a syringe-like plunger 40 whereby the plunger can be used to force cleaning fluid 22 out of the nozzle 35 under pressure thereby creating a pressurized stream for cleaning a proximate object.

1 Claim, 17 Drawing Sheets

LIQUID FILLED SQUEEGEE FOR SIDE VIEW MIRROR

BACKGROUND OF THE INVENTION

1. Field of the Invention

The present invention relates generally to squeegees and, more specifically, to a cleaning device having a refillable squeezable receptacle having means for refilling and securing said receptacle after filling. Said cleaning device having an applicator member being a sponge for scrubbing and a blade for scrapping and having a fluid transference conduit between said receptacle and said sponge.

Furthermore the present invention provides an alternate embodiment having a refillable squeezable receptacle having means for refilling and securing said receptacle after filling. Said cleaning device having an applicator member being a sponge for scrubbing and a blade for scrapping and a nozzle for ejecting the fluid directly onto a surface and having fluid transference conduit between said receptacle and said sponge and said nozzle.

In addition the present invention provides an additional alternate embodiment having a refillable receptacle having means for refilling and a plunger for forcing said fluid through either the sponge or through a nozzle. Said cleaning device having an applicator member being a sponge for scrubbing and a blade for scrapping and a nozzle for ejecting the fluid directly onto a surface and having fluid transference conduit between said receptacle and said sponge and said nozzle.

2. Description of the Prior Art

There are other squeegees device designed for applying and scraping a cleaning solution from a surface. Typical of these is U.S. Pat. No. 5,347,676 issued to Saitoh on Sep. 20, 1994.

Another patent was issued to Fany on Jul. 4, 1995 as U.S. Pat. No. 5,429,678. Yet another U.S. Pat. No. 3,810,702 was issued to Benz on May 14, 1974. Another was issued on Sep. 24, 1974 to Seymour as U.S. Pat. No. 3,837,747 and still yet another was issued on Sep. 27, 1957 to Leopoldi as U.S. Pat. No. 2,886,839.

In order that liquid swept up by blades is introduced positively into a base plate section to elevate a recovery percentage of liquid, the base plate section is adapted to include an open section positioned on the upper end portion of the blades along them and which is opened forwardly in the opening direction of the squeegee, and a throug-like section for introducing liquid having a profile which is defined in such that its axial direction extends along the upper end portion of the blades and its wall surface protrudes backwardly in the operating direction, whereby liquid swept up by these blades is transferred from the lower end portion of the blades to the upper end portion thereof to be introduced into the section for introducing liquid.

A car-cleaning implement (1) comprises a spongy resilient-flexible liquid-absorbent block (2) having an exposed face (3) for applying soapy water, and its opposite face sheathed with a thin flexible skin (4) which is not water absorbent and is formed with parallel ribs (5) extending between opposite ends of the block. By inverting the block after washing off the soapy water, the ribbed skin can be used to remove water droplets from the painted surface of the car without streaking.

A device for cleaning surfaces consists of a cleaning body and a rinsing tube mounted on one end of an arm which is secured at its other end to an operating rod. The end of the arm connected to the cleaning body is formed of a torsion rod while its other end is fixed to the operating rod in a friction-fit joint. The cleaning body and rinsing tube extend transversely of the longitudinal axis of the arm and are angularly revolveable about the longitudinal axis of the arm due to its torsion rod.

A self-contained, cleaning appliance is comprised of a tubular shaped handle forming a liquid reservoir and including an end portion detachably connected to a receptacle carrying washer and squeegee elements. The washer element is in selective fluid communication with the reservoir in response to selective positioning of a value means operatively supported by the receptacle. In a preferred construction, the receptacle, handle, and valve means are fabricated from a plastic material.

This United States patent discloses a window cleaning device being comprised of a compressible container having means for providing a cleaning fluid spray, sponge, a squeegee and a rigid scraper being mounted on said compressible container.

While these squeegees device may be suitable for the purposes for which they were designed, they would not be as suitable for the purposes of the present invention, as hereinafter described.

SUMMARY OF THE PRESENT INVENTION

The present invention discloses a squeegee having an enlarged receptacle for storing cleaning fluid therein. The receptacle is equipped with filling means whereby fluid can be placed inside the receptacle. The present invention is equipped with a head member having a blade for wiping a proximate object along with a sponge-like member for scrubbing the proximate object. Alternative embodiments are provided wherein a nozzle is placed on the applicator head whereby the receptacle can be squeezed thereby forcing a stream of fluid through the nozzle onto the proximate object to be cleaned. In another alternative embodiment the receptacle is equipped with a syringe-like plunger whereby the plunger can be used to force cleaning fluid out of the nozzle under pressure thereby creating a pressurized stream for cleaning a proximate object.

A primary object of the present invention is to provide a cleaning device having a reservoir container for holding and means for dispensing a cleaning fluid by compressing a container.

Another object of the present invention is to provide a cleaning device having a reservoir container for holding and means for dispensing a cleaning fluid by compressing a container and having means for dispensing a quantity of said cleaning fluid directly onto a surface to be cleaned.

Yet another object of the present invention is to provide a cleaning device having a reservoir container for holding and means for withdrawing an amount of cleaning fluid from another container and means for dispensing the cleaning fluid by pushing a plunger and having means for dispensing a quantity of said cleaning fluid directly onto a surface to be cleaned.

Additional objects of the present invention will appear as the description proceeds.

The present invention overcomes the shortcomings of the prior art by providing a cleaning device having a refillable squeezable receptacle having means for refilling and securing said receptacle after filling. Said cleaning device having an applicator member being a sponge for scrubbing and a blade for scrapping and having a fluid transference conduit between said receptacle and said sponge. Furthermore the present invention provides an alternate embodiment having a refillable squeezable receptacle having means for refilling and securing said receptacle after filling. Said cleaning device having an applicator member being a sponge for scrubbing and a blade for scrapping and a nozzle for ejecting the fluid directly onto a surface and having fluid transference conduit between said receptacle and said sponge and said nozzle.

In addition the present invention provides an additional alternate embodiment having a refillable receptacle having means for refilling and a plunger for forcing said fluid through either the sponge or through a nozzle. Said cleaning device having an applicator member being a sponge for scrubbing and a blade for scrapping and a nozzle for ejecting the fluid directly onto a surface and having fluid transference conduit between said receptacle and said sponge and said nozzle.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

DESCRIPTION OF THE PREFERRED EMBODIMENT(S)

Figure 1:
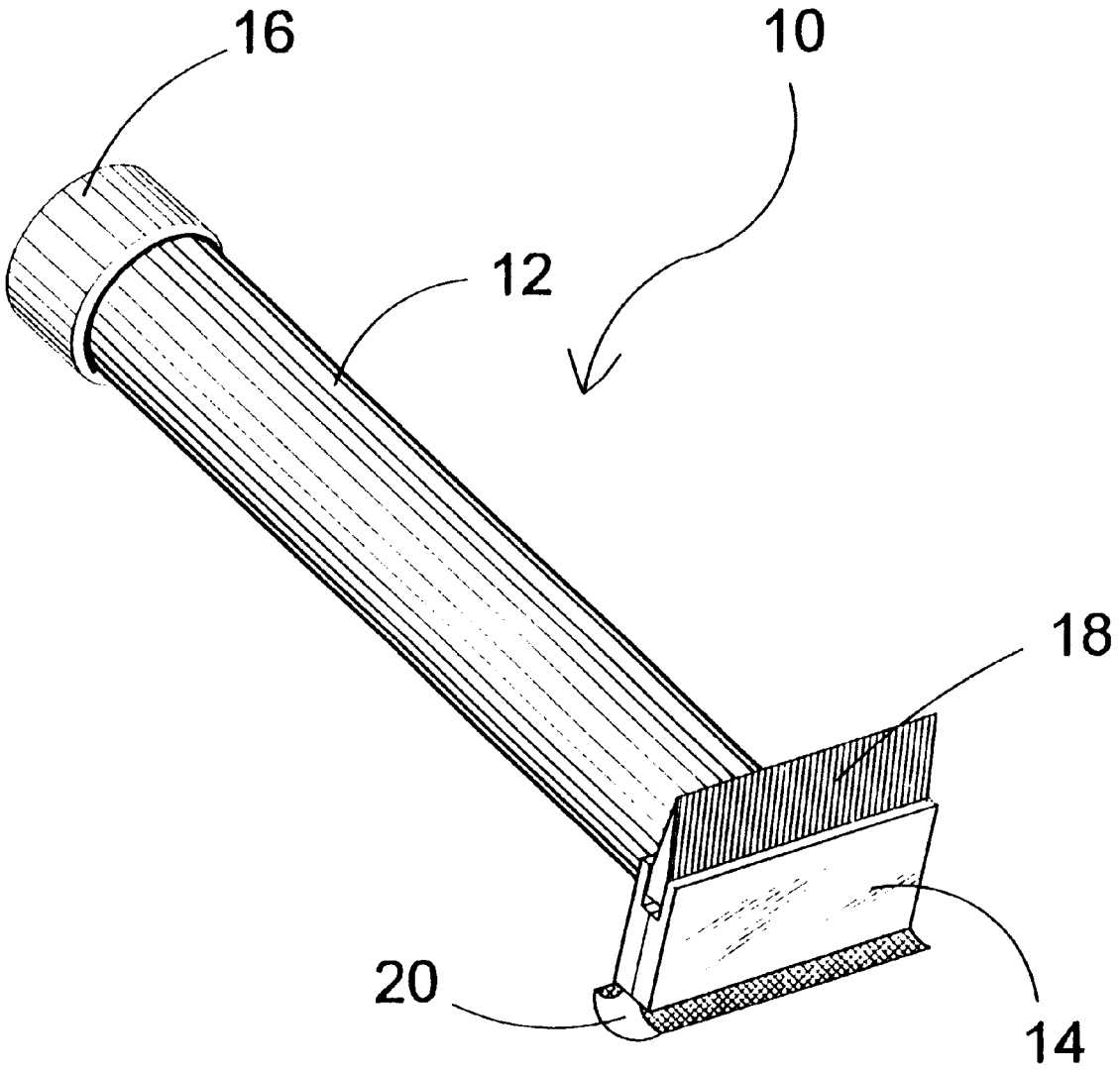
FIG. 1 is a perspective view of the preferred embodiment of the present invention. Shown is a refillable squeezable receptacle having an applicator member on one distal end and removable means for filling said receptacle on the other distal end.

Turning now descriptively to the drawings, in which similar reference characters denote similar elements throughout the several views, FIGS. 1 through 17 illustrate the present invention being a squeegee having a refillable receptacle.

Turning to FIG. 1, therein is shown perspective view of the preferred embodiment of the present invention 10. Shown is a refillable, squeezable receptacle 12 having flexible walls having an applicator head member 14 on one distal end and removable means for filling or inputting fluid 16, e.g., a threaded cap, the receptacle 12 on the other distal end. Also shown therein is the cleaning blade 18 and sponge 20 of the applicator head 14.

Figure 2:
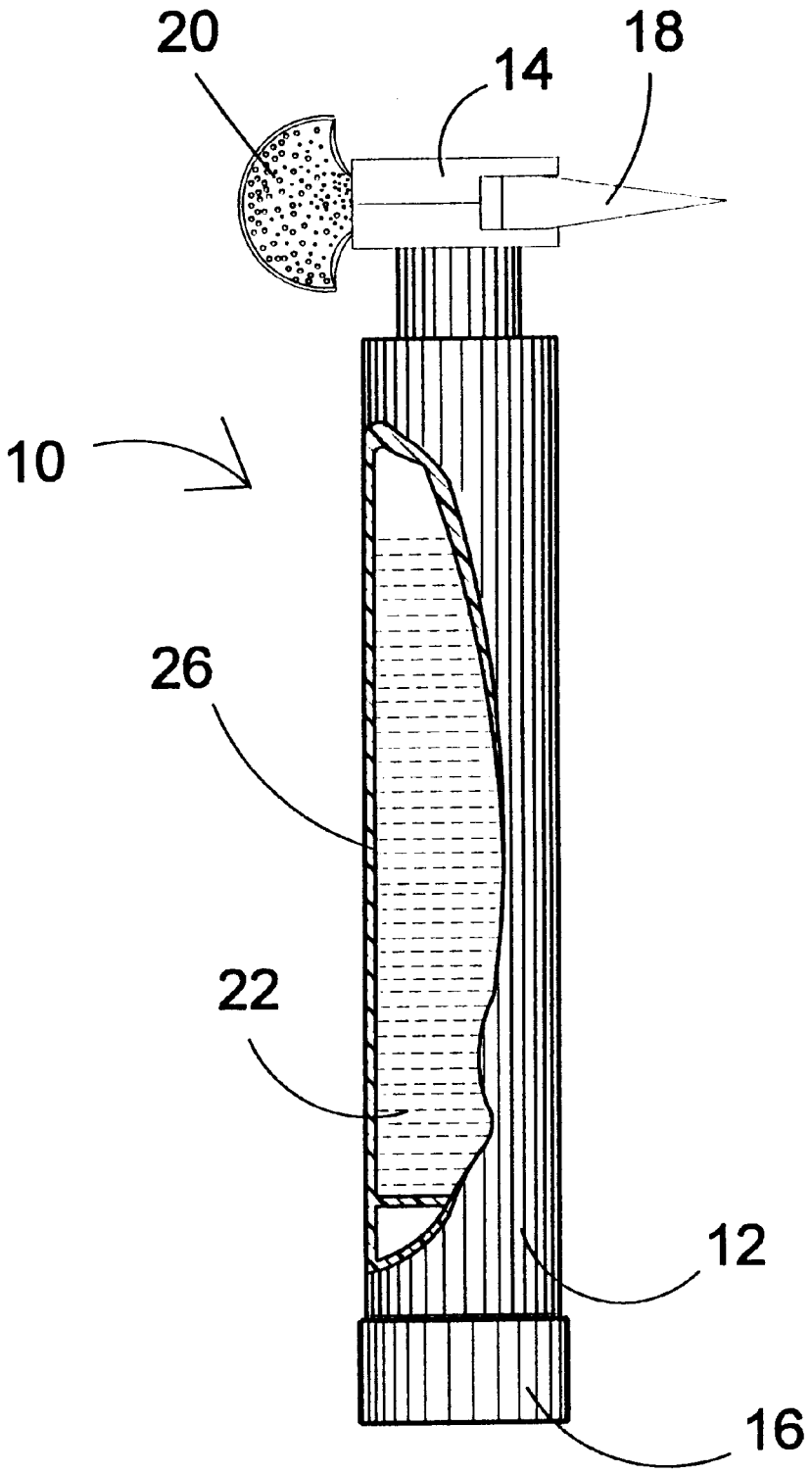
FIG. 2 is a cutaway view of the preferred embodiment of the present invention. Shown is the refillable squeezable receptacle having an amount of fluid contained therein.

Turning to FIG. 2, therein is shown a cutaway view of the preferred embodiment of the present invention 10. Shown is the refillable, squeezable receptacle 12 forming a reservoir with flexible walls 26 having an amount of cleaning fluid 22 contained therein. Also shown is the cap 16, the blade 18, the applicator head 14, along with the sponge 20.

Figure 3:
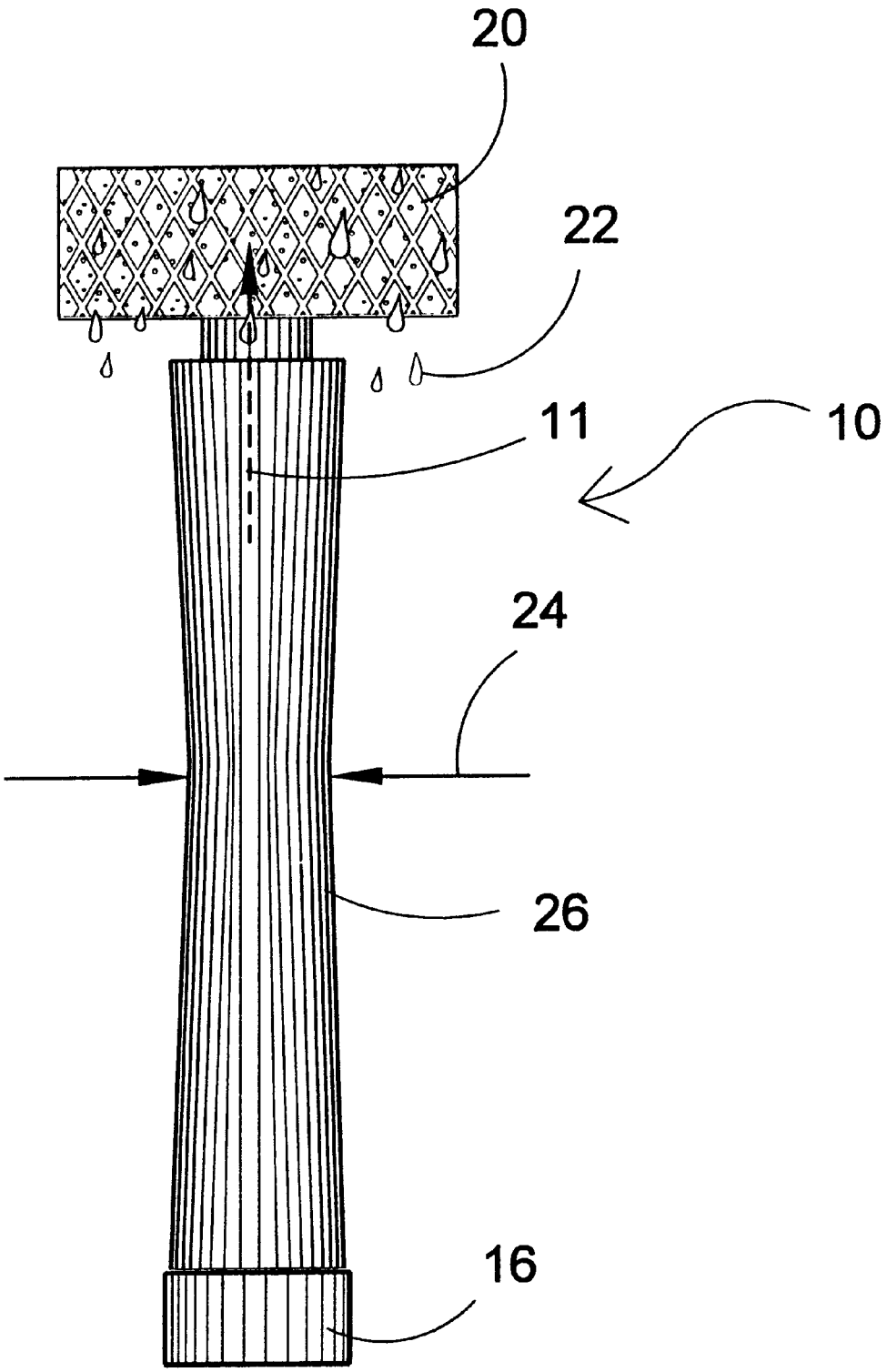
FIG. 3 is an illustrative view of the preferred embodiment of the present invention. Shown is a force being applied to the walls of the refillable squeezable receptacle whereby the fluid contained therein is injected into the sponge.

Turning to FIG. 3, therein is shown an illustrative view of the preferred embodiment of the present invention 10. Shown is a force depicted by arrows 24 applied inwardly to the walls 26 of the refillable, squeezable receptacle whereby the fluid 22 contained therein is expelled and emitted from the sponge 20 of the applicator head. Cap 16 is also shown. Arrow line 11 indicates fluid 22 flow through the present invention 10.

Figure 4:
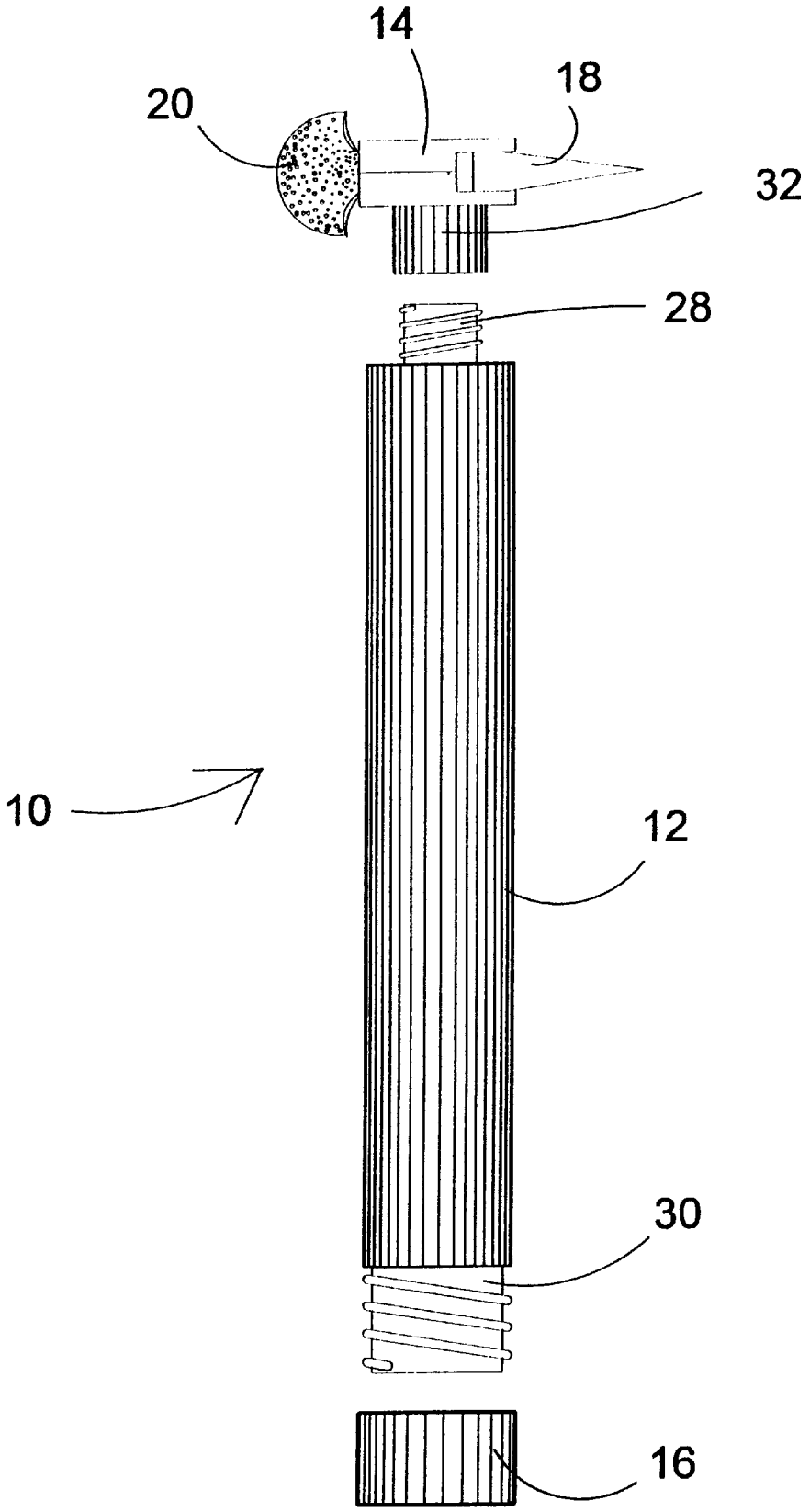
FIG. 4 is an exploded view of the components of the preferred embodiment of the present invention. Shown is a housing member having threaded distal ends having an applicator head member and a base member Said base member is a removable cap-like member providing means for filling and sealing said container. The applicator head member is comprised of threaded attachment means and having a scrubbing element and a scraping element.

Turning to FIG. 4, therein is shown an exploded view of the components of the preferred embodiment of the present invention 10. Shown is an elongated housing member 12 having threaded male distal ends 28 and 30 having an applicator head member 14 connected to a base member 32. The base member 32 is a removable, threaded female structure or cap-like member providing means for connecting to and filling and sealing the container 12. The applicator head member 14 is comprised of the threaded attachment means 32 having a scrubbing or sponge element 20 along with a blade or scraping element 18. Also shown is cap 16 having female threads being attachable to threaded member 30.

Figure 5:
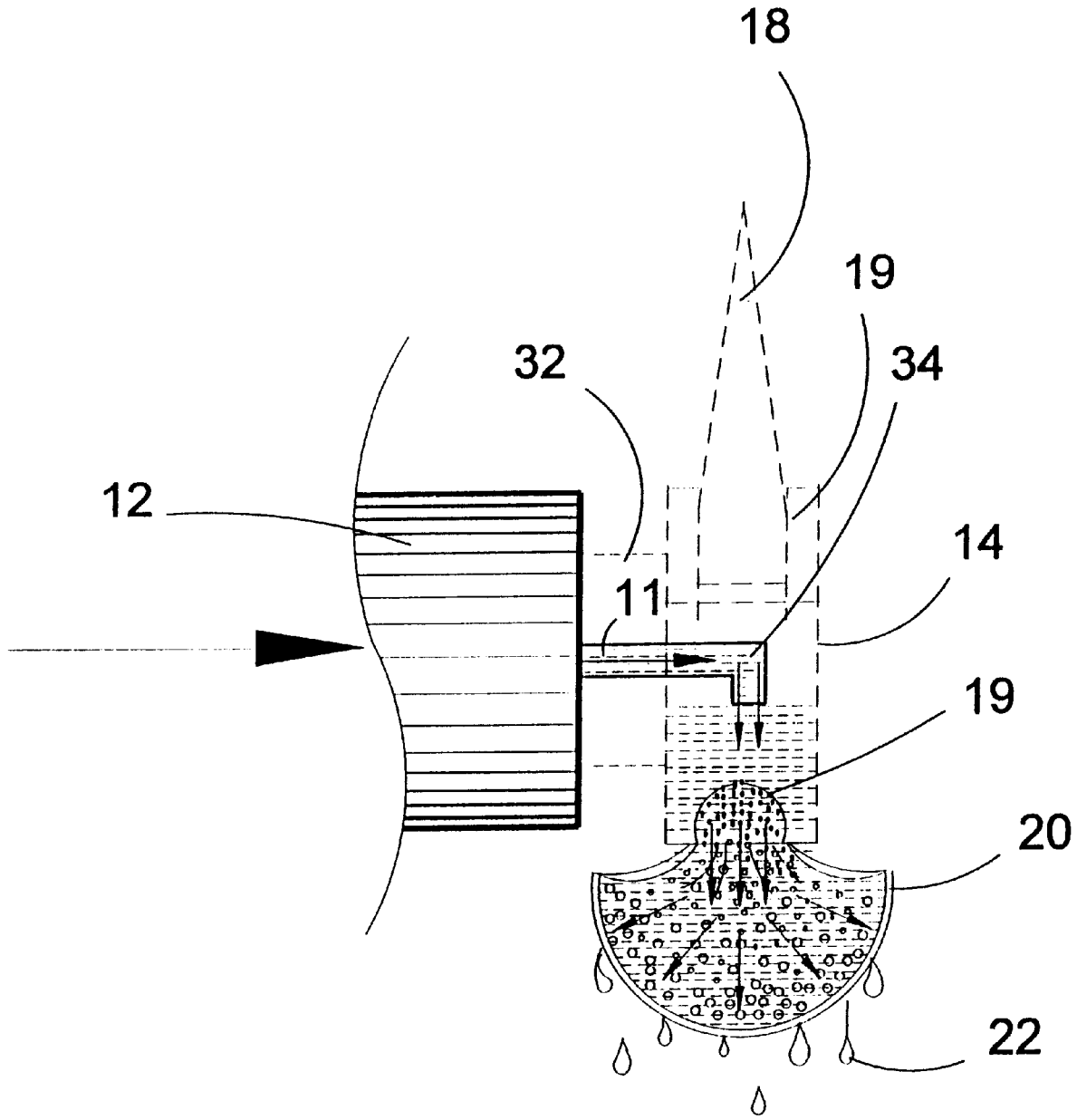
FIG. 5 is an illustrative view of the fluid transference conduit communicating between the liquid reservoir housing and the sponge. Also shown in outline is the squeegee blade.

Turning to FIG. 5, therein is shown an illustrative view of the fluid 22 transfer conduit 34 and fluid flow arrow 11 fluidly communicating between the liquid reservoir housing 12 and the sponge 20 through head 14. Also shown in outline is the squeegee blade 18 along with base 32. Also shown are means 19 for connecting blade 18 and sponge 20 to head 14.

Figure 6:
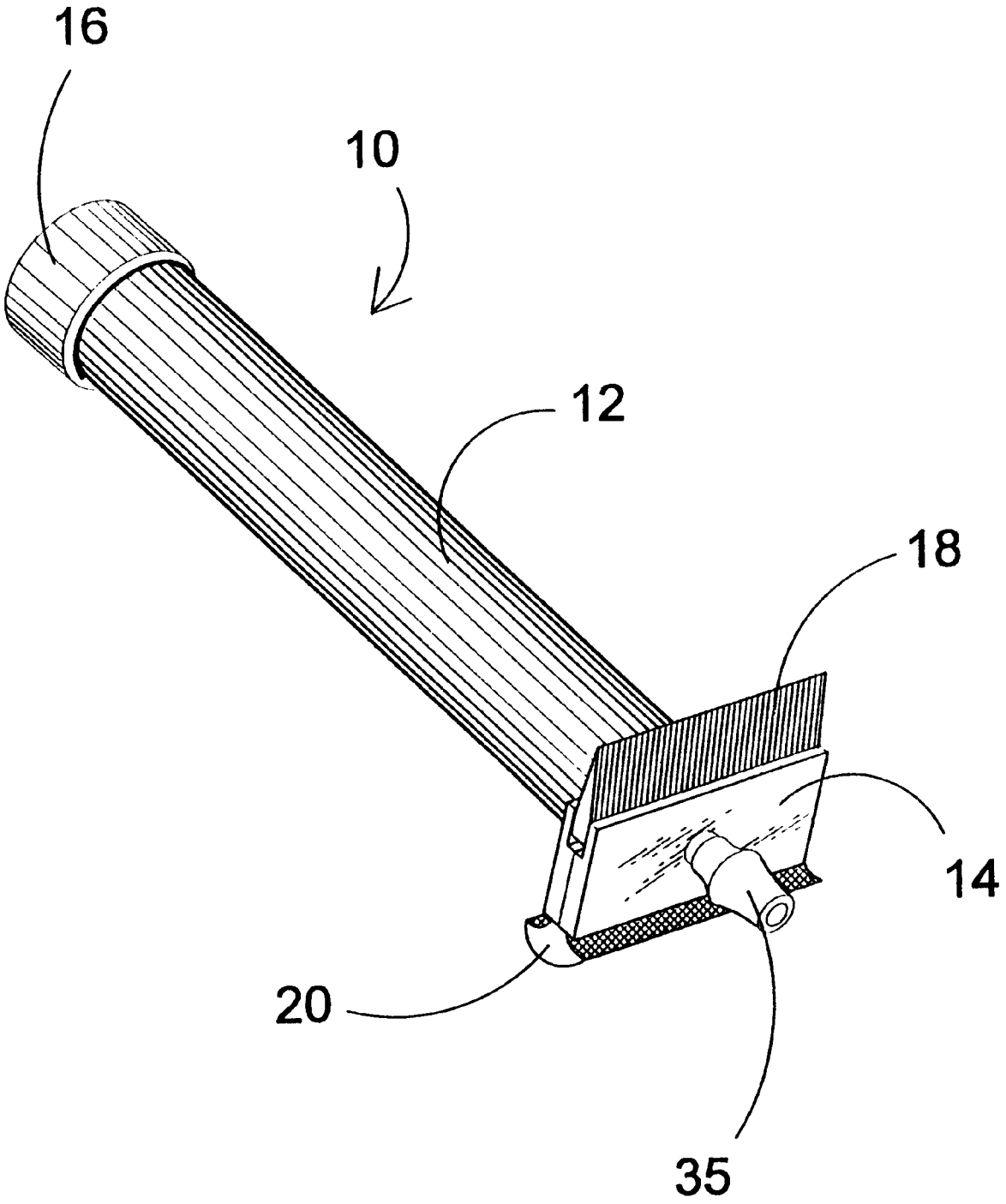
FIG. 6 is a perspective view of the alternate embodiment of the present invention. Shown is a squeezable refillable receptacle for storing a fluid therein having a nozzle for dispensing said fluid when said nozzle is in the open position and sponge dispensing means when the nozzle is in the closed position.

Turning to FIG. 6, therein is shown a perspective view of the alternative embodiment of the present invention 10. Shown is the squeezable, refillable receptacle 12 for storing fluid therein having a nozzle 35 member for dispensing fluid when the nozzle 35 is in an open position and sponge dispensing means 20 when the nozzle 35 is in the closed position. Other elements of the invention previously discussed are also shown.

Figure 7:
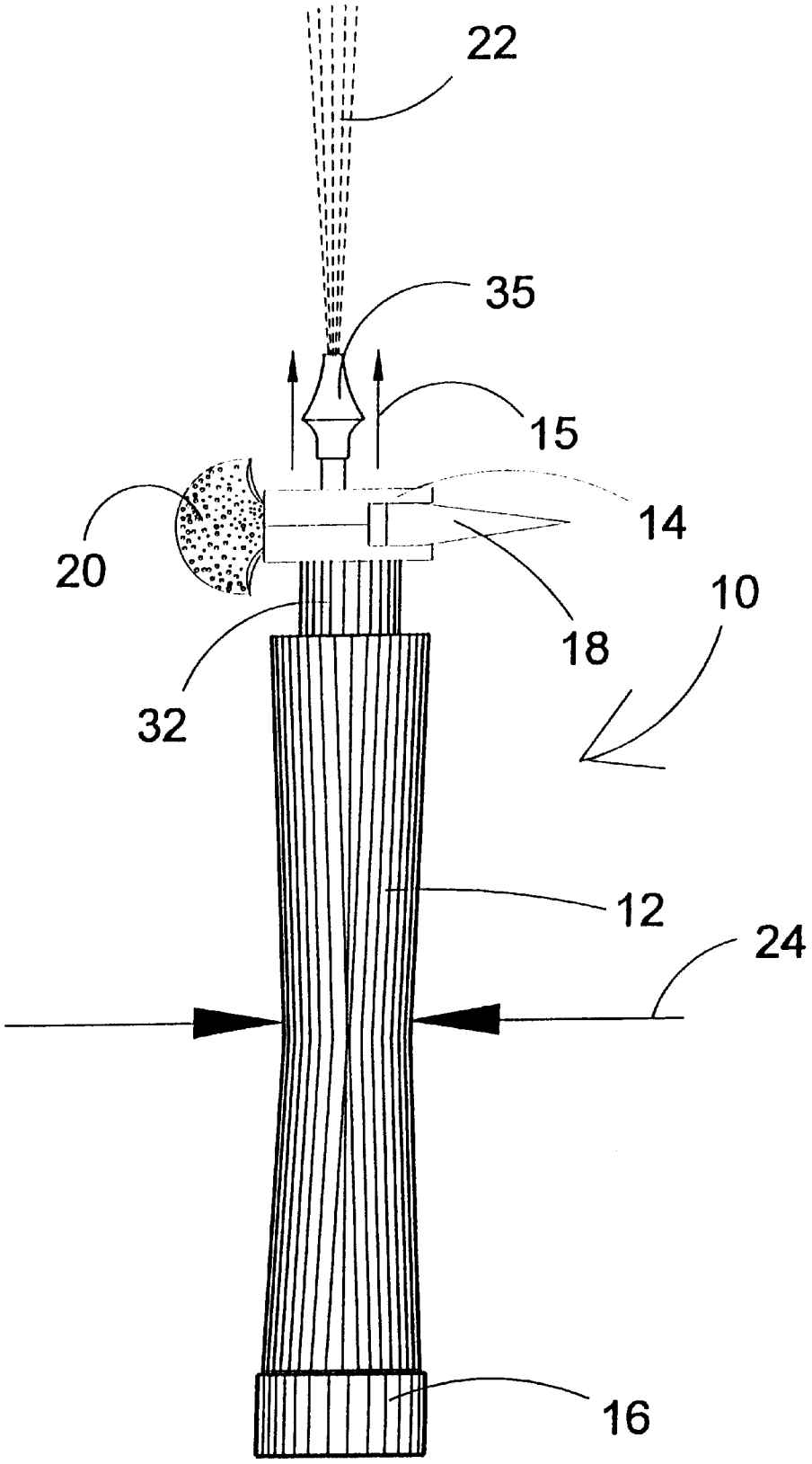
FIG. 7 is a perspective view of the alternate embodiment of the present invention. Shown is a squeezable refillable receptacle for storing a fluid therein having a nozzle for dispensing said fluid when said nozzle is in the open position and sponge dispensing means when the nozzle is in the closed position.

Turning to FIG. 7, therein is shown a perspective view of the alternative embodiment of the present invention 10. Shown is a squeezable, refillable receptacle 12 for storing the fluid 22 therein having a nozzle 35 for dispensing the fluid 22 when the nozzle 35 is in the open or extended position as shown by direction arrows 15 and sponge dispensing means 20 when the nozzle 35 is in the closed position. Other elements of the invention previously discussed are also shown.

Figure 8:
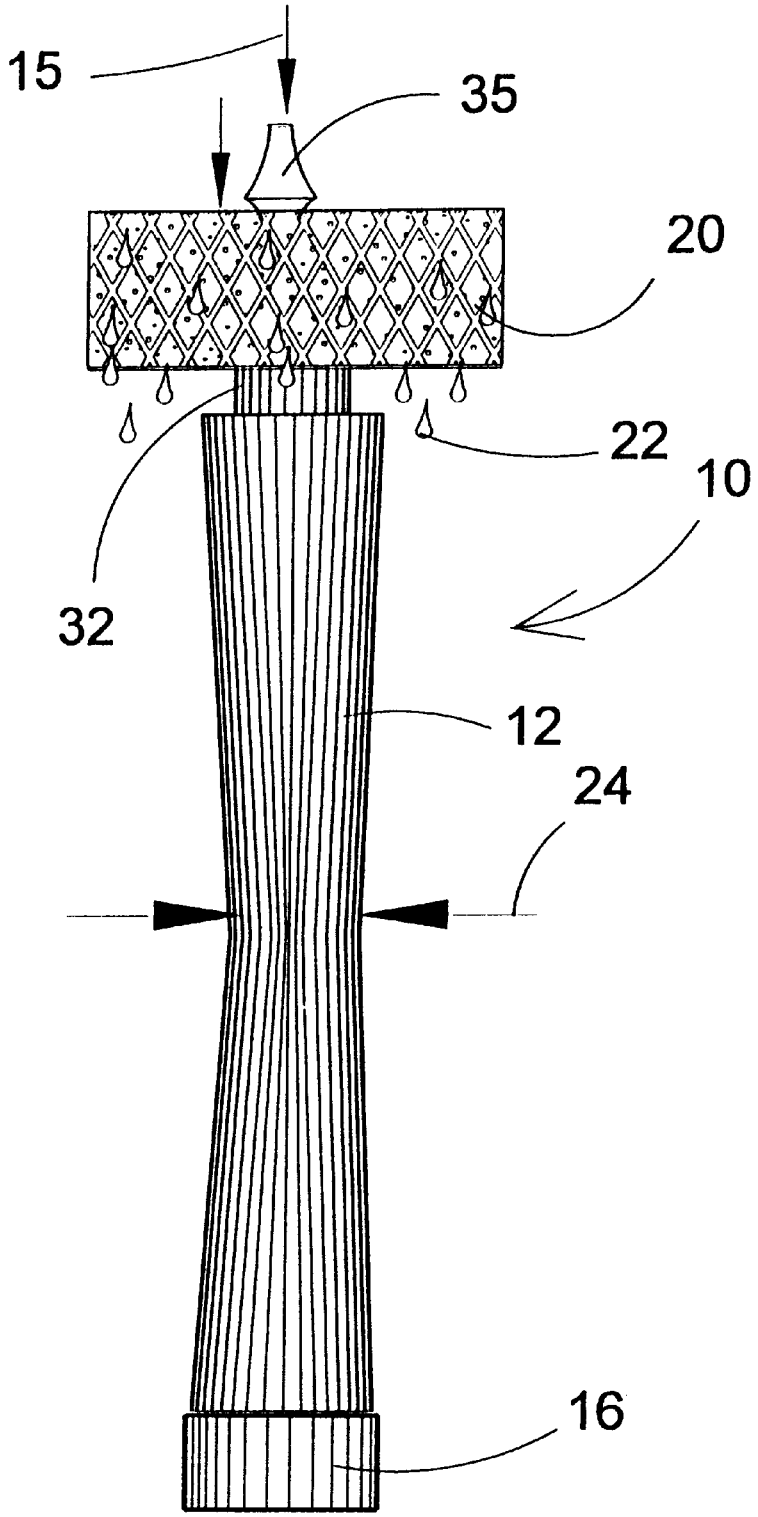
FIG. 8 is a perspective view of the alternate embodiment of the present invention. Shown is a squeezable refillable receptacle for storing a fluid therein having a closed nozzle whereby the fluid under pressure will be dispensed through the sponge.

Turning to FIG. 8, therein is shown a perspective view of the alternative embodiment of the present invention 10. Shown is a squeezable, refillable receptacle 12 for storing the fluid 22 having a closed nozzle 35 shown by arrow 15 whereby the fluid 22 being under pressure will be dispensed from the sponge 20. Other elements of the invention which have been previously disclosed are also shown.

Figure 9:
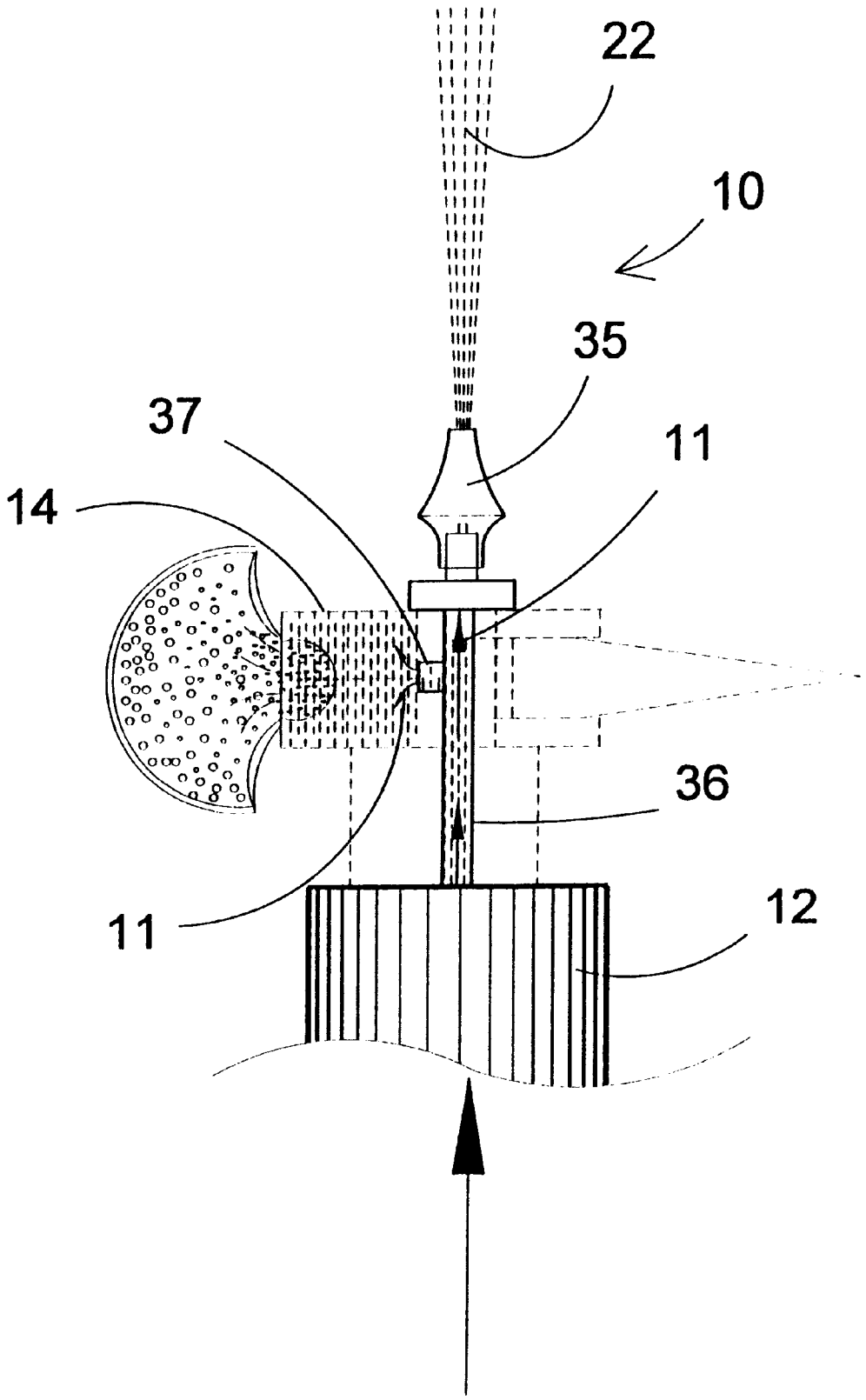
FIG. 9 is an illustrative view of the applicator member of the alternate embodiment of the present invention. Shown is the refillable squeezable receptacle ejecting an amount of fluid through a fluid transference conduit, through the open nozzle of the device.

Turning to FIG. 9, therein is shown an illustrative view of the applicator head member 14 of the alternative embodiment of the present invention 10. Shown is the refillable, squeezable receptacle 12 ejecting an amount of fluid 22 through the alternative fluid transfer conduit 36 and then through the open nozzle 35 of the present invention 10. Other elements previously discussed are also disclosed. Fluid 22 flows out nozzle 35 with a small amount going out auxiliary conduit 37.

Figure 10:
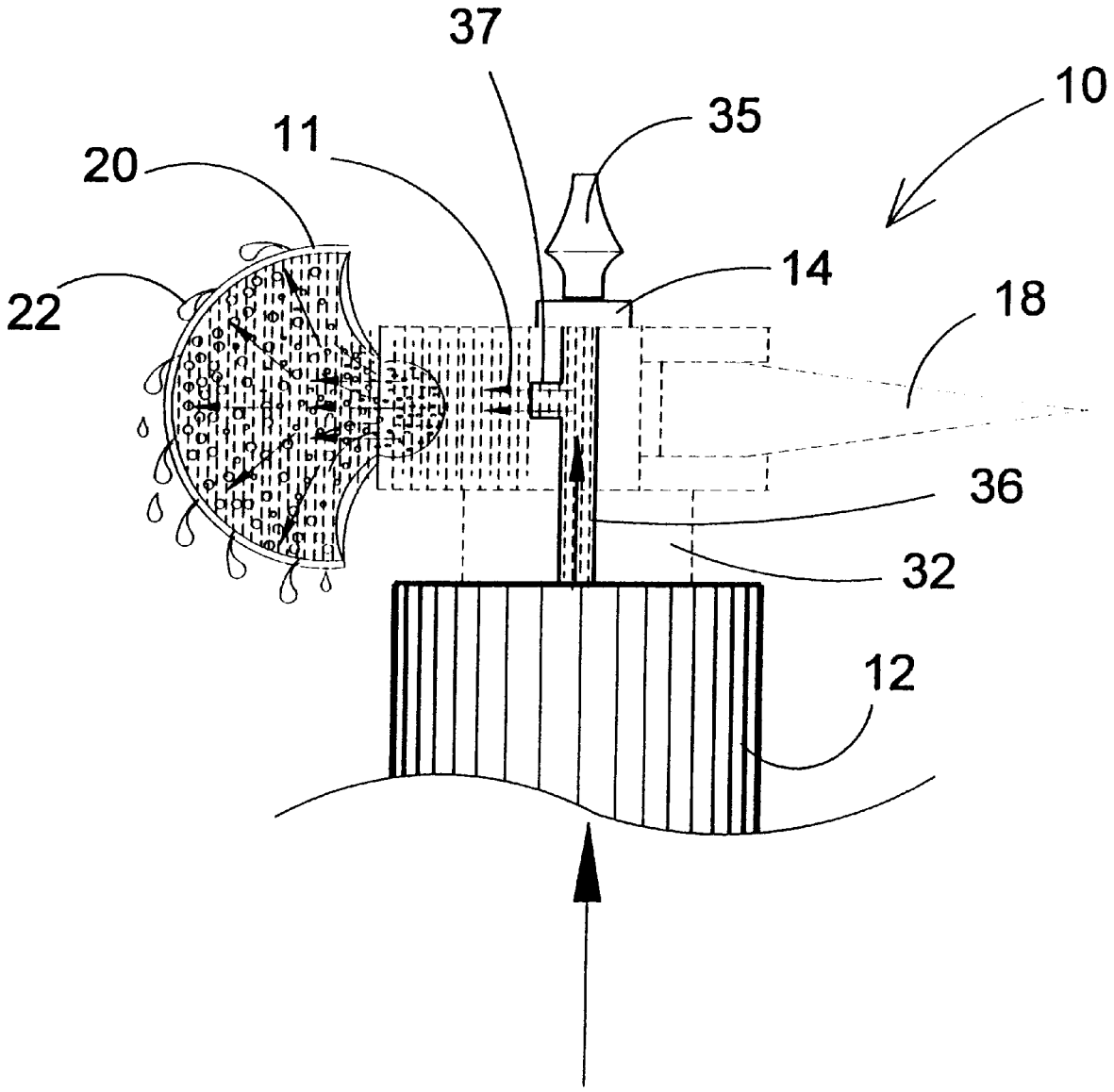
FIG. 10 is an illustrative view of the applicator member of the alternate embodiment of the present invention. Shown is the refillable squeezable receptacle ejecting an amount of fluid through a fluid transference conduit, through the sponge portion of the applicator he ad member.

Turning to FIG. 10, therein is shown an illustrative view of the applicator member 14 of the alternative embodiment of the present invention 10. Shown is the refillable, squeezable receptacle 12 ejecting an amount of fluid 22 through a fluid transfer conduit 37 through the sponge portion 20 of the applicator head 14 member due to nozzle 35 being in the closed position. Other elements previously discussed are also shown. Nozzle 35 is an on/off or open/closed nozzle of the standard type.

Figure 11:
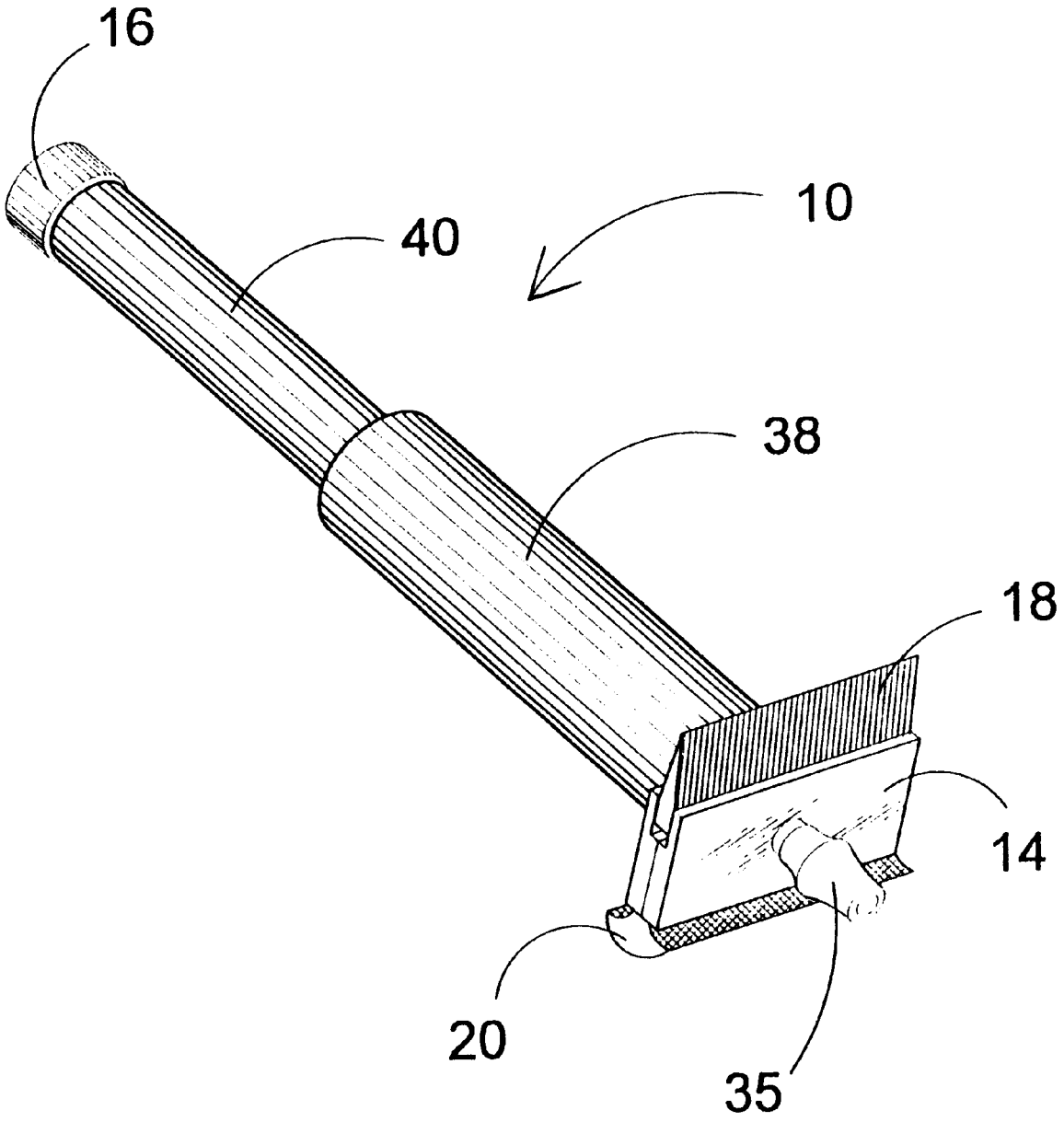
FIG. 11 is a perspective view of An additional alternate embodiment of the present invention. Shown is a syringe-like receptacle for storing a fluid therein having a plunger for dispensing said fluid when said nozzle is in the open position and sponge dispensing means when the nozzle is in the closed position.

Turning to FIG. 11, therein is shown a perspective view of an additional alternative embodiment of the present invention 10. Shown is a syringe-like receptacle 38 for storing fluid therein having a plunger 40 for dispensing said fluid when said nozzle 35 is in the open position and sponge dispensing means 20 when the nozzle 35 is in the closed position. Nozzle 35 is constructed as shown in FIGS. 9 and 10.

Figure 12:
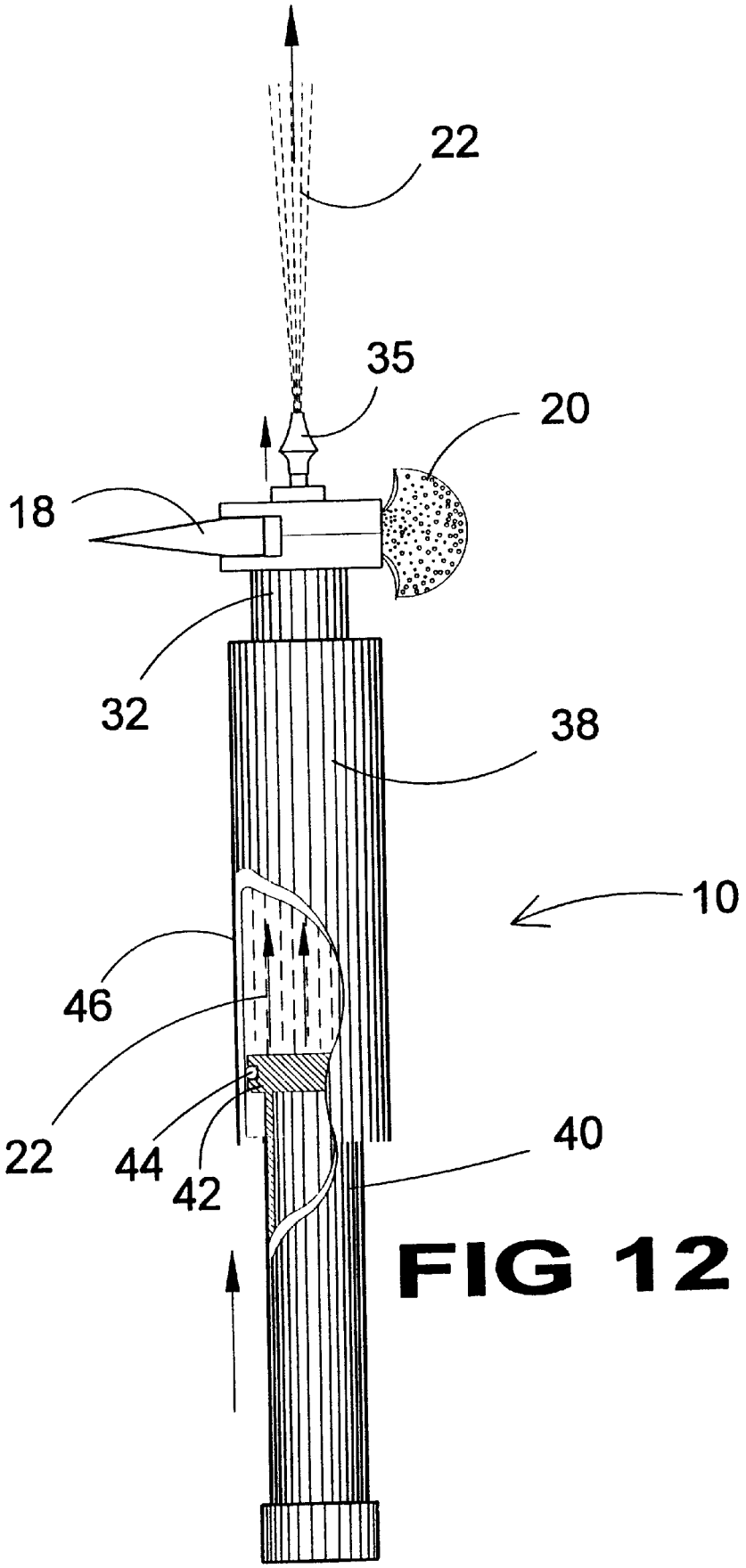
FIG. 12 is a cutaway perspective view of the additional alternate embodiment of the present invention. Shown is a syringe-like receptacle for storing a fluid therein having a plunger and a nozzle for dispensing said fluid therethrough when the nozzle is in the open position.

Turning to FIG. 12, therein is shown a cutaway perspective view of the additional alternative embodiment of the present invention 10. Shown is a syringe-like receptacle 38 forming a hollow barrel for storing a fluid 22 therein having a plunger member 40 and a nozzle 35 for dispensing fluid 22 therethrough when the nozzle 35 is in the open position. Also shown is the enlarged plunger head 42 having an O-ring 44 about it peripheral edge whereby the O-ring causes the plunger head 42 to seal against the wall 46 of the receptacle 38 thereby forcing the fluid 22 out of the receptacle 38 into the nozzle head 35.

Figure 13:
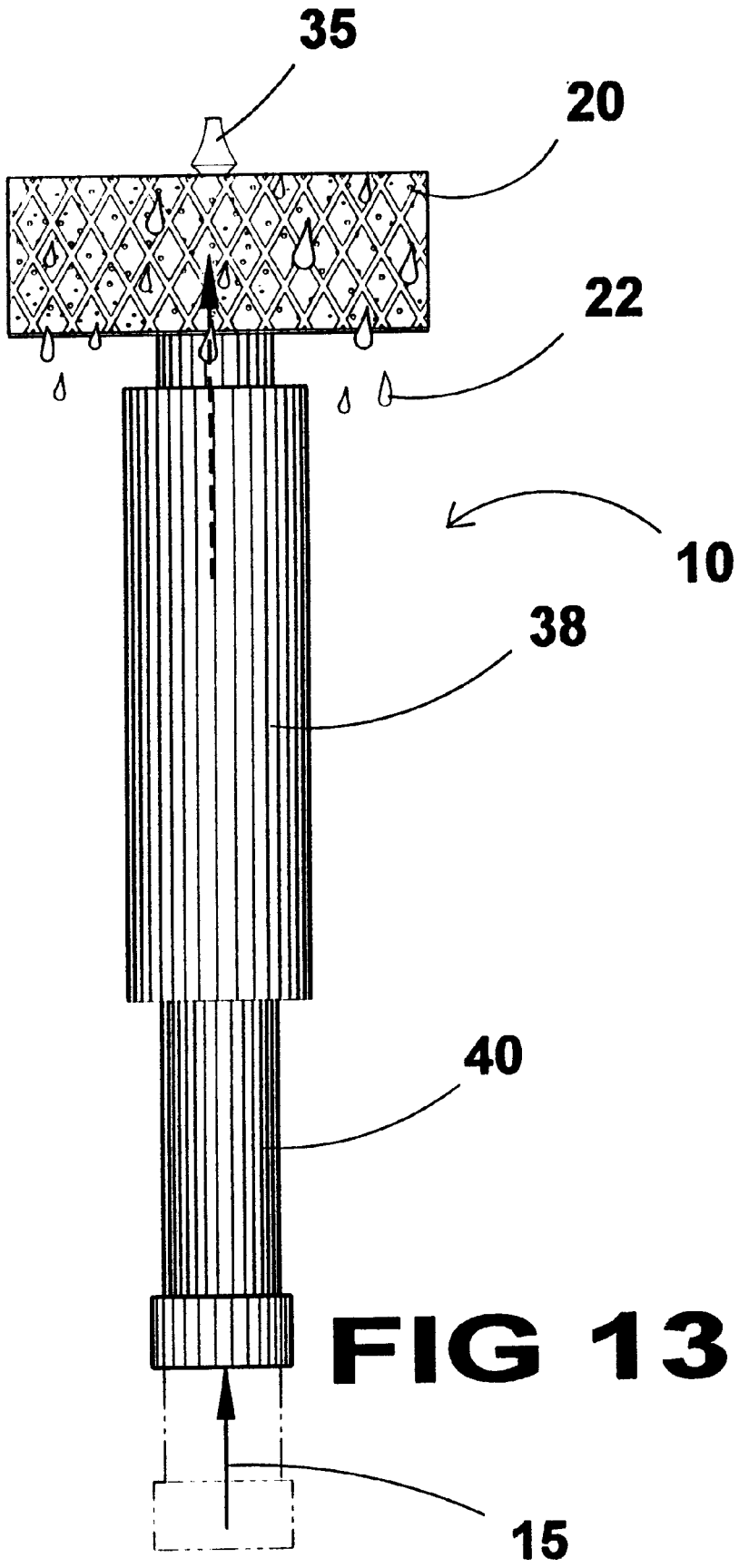
FIG. 13 is a cutaway perspective view of the additional alternate embodiment of the present invention. Shown is a syringe-like receptacle for storing a fluid therein having a plunger for dispensing said fluid through the sponge when the nozzle is in the closed position.

Turning to FIG. 13, therein is shown a cutaway perspective view of the additional alternative embodiment of the present invention 10. Shown is a syringe-like receptacle 38 for storing fluid 22 therein having a plunger 40 for dispensing the fluid through the sponge 20 when the nozzle 35 is in the closed position as shown in FIG. 13. Direction arrow 15 shows plunger 40 being moved inwardly.

Figure 14:
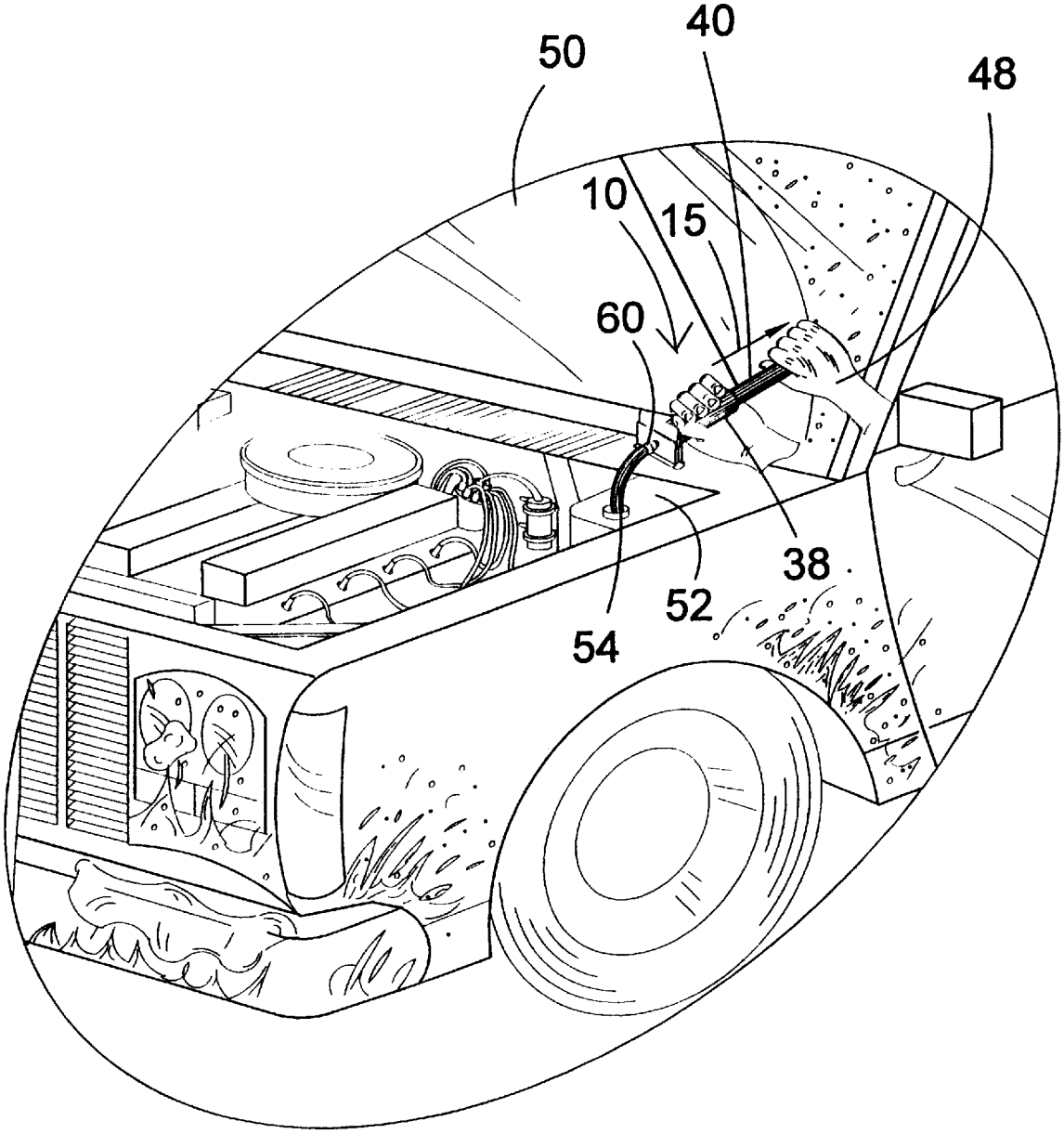
FIG. 14 is an illustrative view of one application of the additional alternate embodiment of the present invention. Shown is a user having the engine hood up and using the additional alternate embodiment to remove some of the cleaning fluid from a container by plunger means.

Turning to FIG. 14, therein is shown an illustrative view of one application of the additional alternative embodiment of the present invention 10. Shown are the hands 48 of a user having a vehicle hood 50 in a raised position using the additional alternative embodiment of FIG. 11 to remove some cleaning fluid (not shown) from a fluid container 52 by using the plunger means 40 having a hose 54 and means 60 for connecting hose 54 to nozzle 35, e.g., a hose clamp or the like. Hose 54 is placed in fluid 52 and plunger 40 is pulled outwardly from receptacle 38 shown by direction arrow 15 causing receptacle 38 to fill with fluid due to a syringe or pump action.

Figure 15:
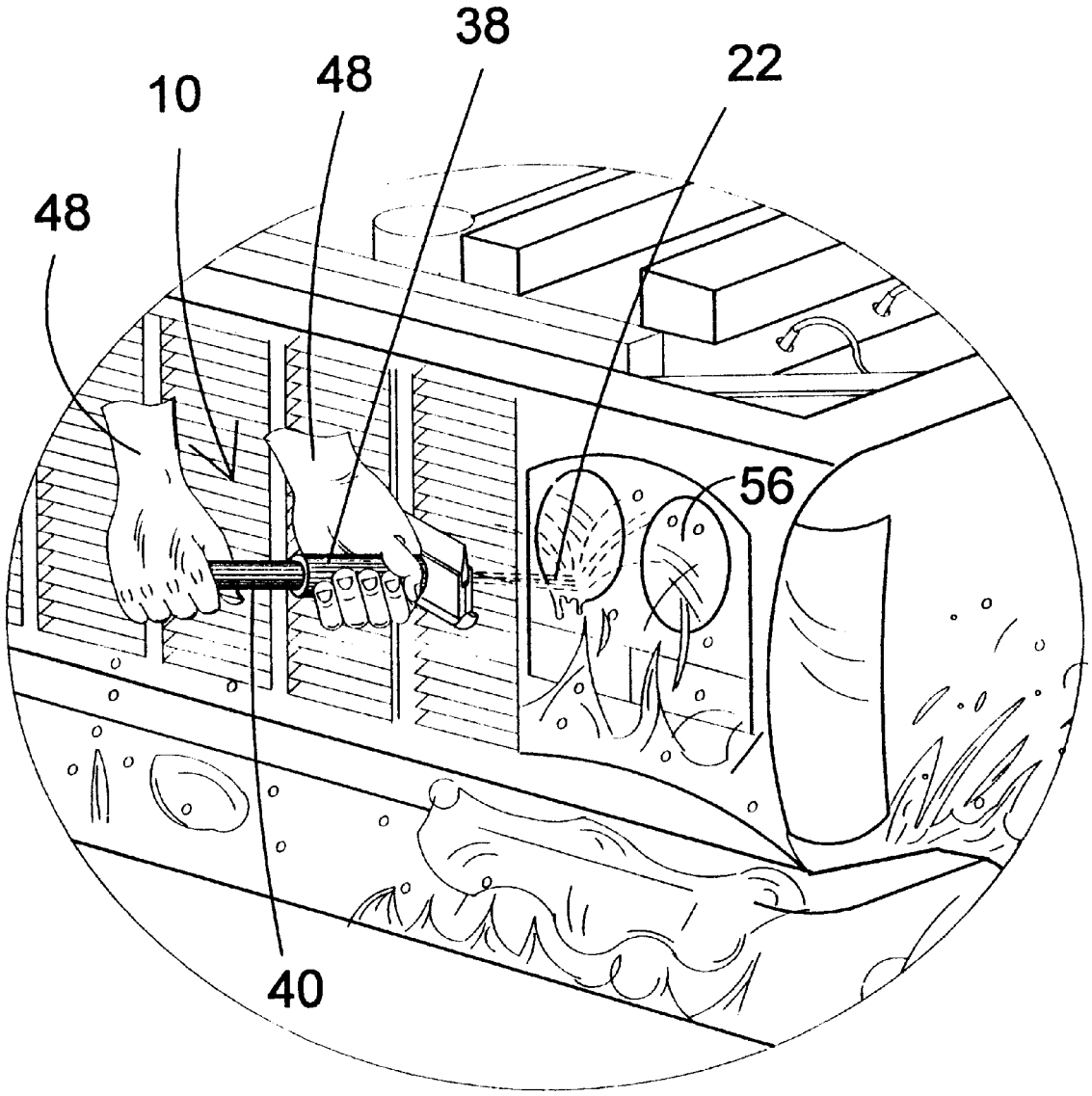
FIG. 15 is an enlarges view of the additional alternate embodiment shown in FIG. 14 wherein the used has extracted cleaning fluid from a cleaning fluid reservoir and is using the same to clean the headlights of a motor vehicle.

Turning to FIG. 15, therein is shown an enlarged view of the additional alternative embodiment shown in FIG. 14 wherein the user's hands 48 have extracted cleaning fluid 22 from a cleaning fluid reservoir 52 and is using the fluid 22 to clean the headlights 56 of a motor vehicle. Shown is plunger 40 being moved inwardly into receptacle 38 forcing fluid 22 out through nozzle 35 (not shown). Other elements previously discussed are also shown.

Figure 16:
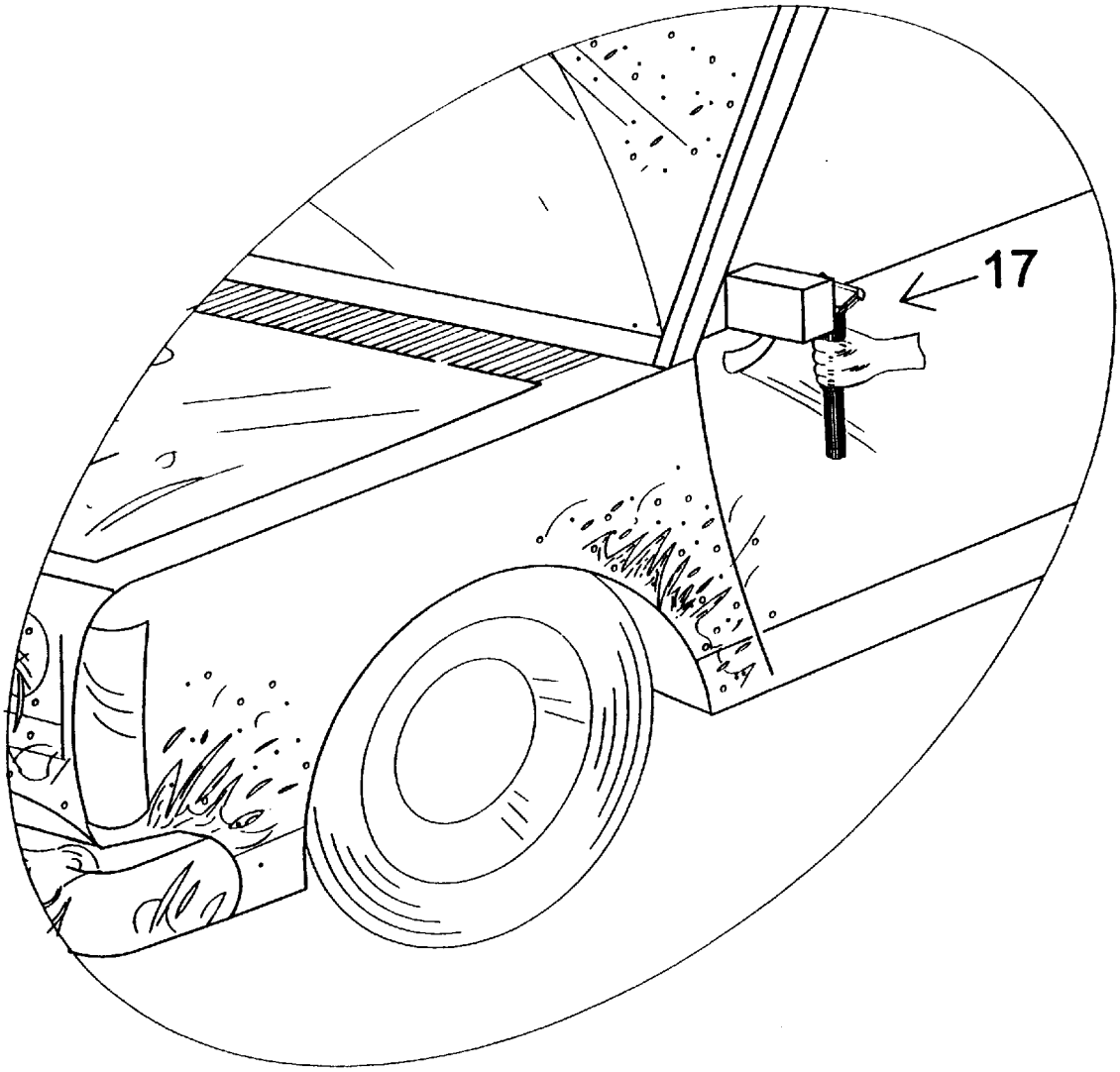
FIG. 16 is an illustrative view of the present invention being used to clean the vehicle's side view mirror.

Turning to FIG. 16, therein is shown an illustrative view of the present invention 10 being used to clean the side view mirrors 58 of a vehicle. Other elements previously discussed are also shown.

Figure 17:
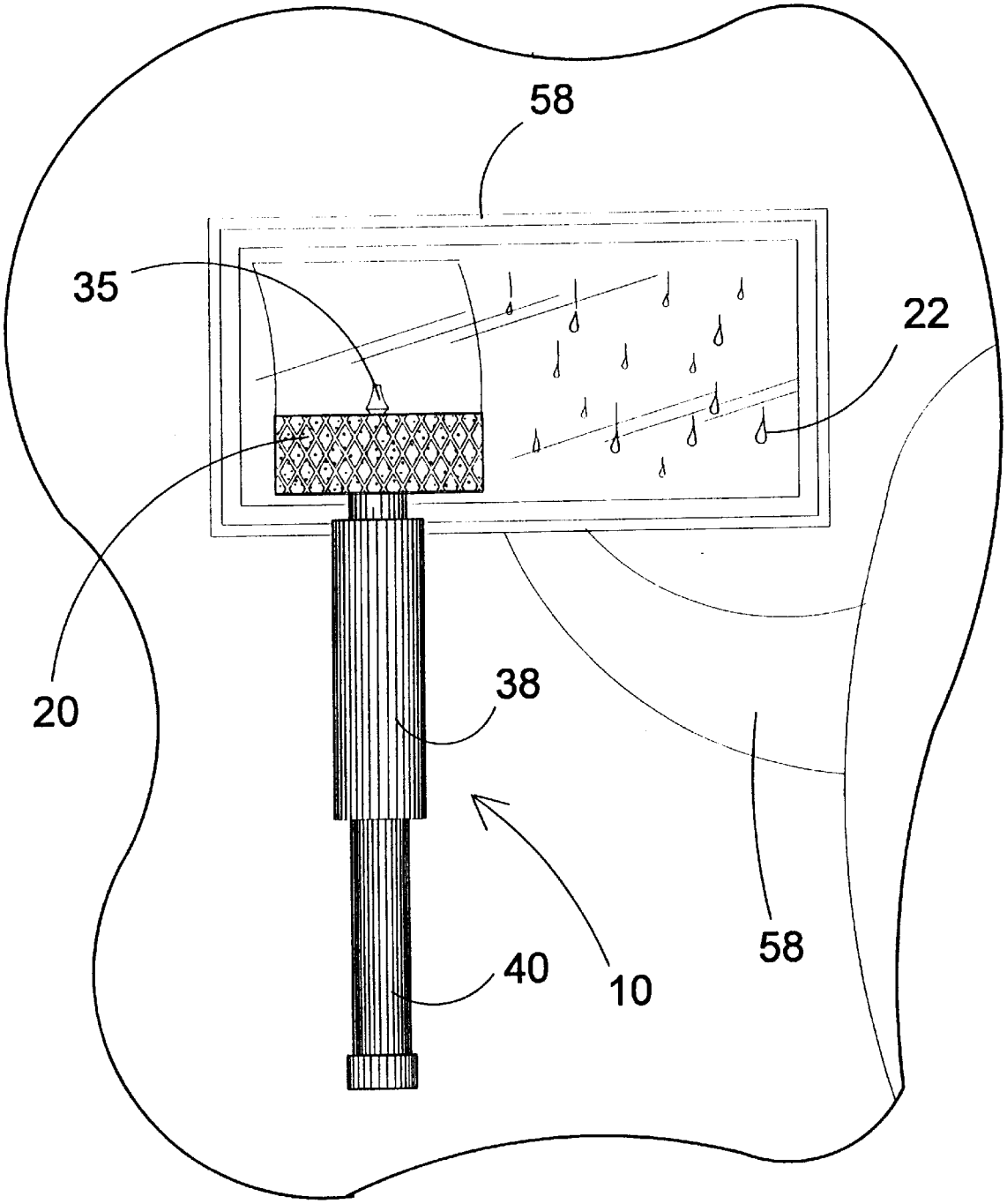
FIG. 17 is a front elevation of the present invention being used to clean the vehicle's side view mirror. The spray member of the invention has been used to apply cleaning fluid. The sponge member can be used to scrub the mirror while the squeegee blade is used to remove dirt and fluids from the mirror.

Turning to FIG. 17, therein is shown a front elevation view of the present invention 10 being used to clean the side view mirrors 58 of a vehicle. Spray nozzle member 35 of the present invention 10 has been used to apply cleaning fluid 22. The sponge member 20 can be used to scrub the mirror 58 while the blade 18 (not shown) is used to remove dirt and fluid 22 from the mirror 58. Other elements previously discussed are also shown.

What is claimed to be new and desired to be protected by Letters Patent is set forth in the claims:

1. An apparatus for cleaning windows with fluid, comprising:

a) an elongated handle;

b) said handle being a barrel and having a slidable plunger therein;

c) a reservoir inside said handle for holding fluid;

d) a cleaning head;

e) means for connecting said cleaning head to a near end of said handle comprising a threaded male means on said handle, said cleaning head having a threaded female means, said cleaning head being attached to said handle by threading said female means onto said male means;

f) a blade attached to said cleaning head;

g) a sponge attached to said cleaning head;

h) means for fluidly connecting said reservoir to said sponge comprising a conduit internal to said cleaning head;

i) a fluid outlet nozzle positioned on said cleaning head fluidly connected to said conduit, said conduit and nozzle aligned with said elongated handle, said blade extending in one direction from said cleaning head at a right angle to said elongated handle and said sponge extending from said cleaning head at a right angle to said elongated handle facing in a direction directly opposite to that of said blade, and said nozzle extending from said cleaning head in a direction opposite that of said handle;

j) said nozzle communicating with said reservoir in said handle through said conduit and having open and closed positions;

k) said sponge being fluidly connected through said conduit to said reservoir when said nozzle is in the closed position;

l) said plunger extending out from a distal end of said handle, slidable movement of said plunger toward said cleaning head causing cleaning fluid to leave said cleaning fluid out through said nozzle when in the open position and said sponge, and slidable movement of said plunger away from said cleaning head drawing fresh cleaning fluid through said nozzle into said reservoir; and m) a hose for connection to said nozzle to draw fresh cleaning fluid into said reservoir from a source of said cleaning fluid.

* * * * *